US010156376B2

(12) United States Patent
Nakai et al.

(10) Patent No.: US 10,156,376 B2
(45) Date of Patent: Dec. 18, 2018

(54) AIR CONDITIONER

(71) Applicant: DAIKIN INDUSTRIES, LTD., Osaka-Shi, Osaka (JP)

(72) Inventors: Satoshi Nakai, Kusatsu (JP); Masafumi Uda, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 120 days.

(21) Appl. No.: 14/431,829

(22) PCT Filed: Aug. 12, 2013

(86) PCT No.: PCT/JP2013/071820
§ 371 (c)(1),
(2) Date: Mar. 27, 2015

(87) PCT Pub. No.: WO2014/050335
PCT Pub. Date: Apr. 3, 2014

(65) Prior Publication Data

US 2015/0285525 A1 Oct. 8, 2015

(30) Foreign Application Priority Data

Sep. 28, 2012 (JP) ..... 2012-215534

(51) Int. Cl.
*F04D 17/04* (2006.01)
*F24F 7/08* (2006.01)
(Continued)

(52) U.S. Cl.
CPC ..... *F24F 7/08* (2013.01); *F04D 17/04* (2013.01); *F04D 29/283* (2013.01);
(Continued)

(58) Field of Classification Search
CPC ..... F24F 7/08; F04D 17/04
(Continued)

(56) References Cited

U.S. PATENT DOCUMENTS 5,547,018 A * 8/1996 Takahashi ..... F24F 1/0011 165/122
5,827,046 A * 10/1998 Konno ..... B29C 45/44 416/178
(Continued)

FOREIGN PATENT DOCUMENTS

CN 1218146 A 6/1999
CN 1233717 A 11/1999
(Continued)

OTHER PUBLICATIONS

Extended European Search Report dated Aug. 1, 2018 in corresponding European Patent Application No. 18167221.3.
(Continued)

*Primary Examiner* — Steven B McAllister
*Assistant Examiner* — Samantha Probst
(74) *Attorney, Agent, or Firm* — Birch, Stewart, Kolasch & Birch, LLP

(57) ABSTRACT

Wind noise is suppressed while an air-blowing performance is maintained.

An indoor unit 1 of an air conditioner includes a cross flow fan 10 and a rear guider 20 and a stabilizer 32 which are provided on the respective sides of the outer periphery of the cross flow fan 10 to form an air passage. Each of the rear guider 20 and the stabilizer 32 has, at least at a part in the axial direction which part is on the leading end side, twisted portions 23, 37. In the circumferential direction of the cross flow fan 10, each twisted portion 23, 37 is deviated from the axial direction of the cross flow fan 10 gradually from one end to the other end.

18 Claims, 12 Drawing Sheets

(51) Int. Cl.

| | |
|---|---|
| ***F24F 1/00*** | (2011.01) |
| ***F04D 29/28*** | (2006.01) |
| ***F04D 29/42*** | (2006.01) |
| ***F04D 29/44*** | (2006.01) |
| ***F04D 29/66*** | (2006.01) |

(52) U.S. Cl.
CPC ..... *F04D 29/422* (2013.01); *F04D 29/441* (2013.01); *F04D 29/665* (2013.01); *F04D 29/666* (2013.01); *F24F 1/0025* (2013.01); *F24F 2001/0048* (2013.01)

(58) Field of Classification Search
USPC ..... 454/249
See application file for complete search history.

(56) References Cited

U.S. PATENT DOCUMENTS

| | | | | | |
|---|---|---|---|---|---|
| 5,924,923 | A * | 7/1999 | Chiguchi | F24F 1/0011 | 165/122 |
| 5,944,481 | A | 8/1999 | Stone et al. | | |
| 6,145,335 | A * | 11/2000 | Nagaoka | F24F 1/0011 | 454/233 |
| 6,338,676 | B1 * | 1/2002 | Kondou | F24F 1/0007 | 454/315 |
| 6,416,285 | B1 * | 7/2002 | Fichter | B23P 15/006 | 29/889 |
| 6,786,061 | B2 * | 9/2004 | Asami | F24F 1/0011 | 165/122 |
| 7,752,862 | B2 * | 7/2010 | Bae | F24F 1/0007 | 165/122 |
| 2005/0279120 | A1 * | 12/2005 | Lee | F24F 1/0007 | 62/419 |
| 2005/0284170 | A1 * | 12/2005 | Lee | F24F 1/0007 | 62/419 |
| 2007/0060036 | A1 * | 3/2007 | Shibuya | B01D 46/0065 | 454/187 |
| 2009/0241576 | A1 * | 10/2009 | Tsuji | F24F 1/0007 | 62/259.1 |
| 2010/0158689 | A1 * | 6/2010 | Nishino | F04D 17/04 | 416/213 A |
| 2010/0159818 | A1 * | 6/2010 | Sakashita | F24F 13/28 | 454/233 |
| 2012/0171945 | A1 * | 7/2012 | Lee | A01M 1/023 | 454/237 |
| 2012/0263573 | A1 * | 10/2012 | Tadokoro | F04D 17/04 | 415/53.1 |
| 2013/0029582 | A1 * | 1/2013 | Takai | B60H 1/3428 | 454/284 |
| 2013/0256056 | A1 * | 10/2013 | Wiegers | F01N 13/18 | 181/282 |

FOREIGN PATENT DOCUMENTS

| | | | |
|---|---|---|---|
| CN | 1286374 | A | 3/2001 |
| CN | 2487893 | Y | 4/2002 |
| CN | 1362585 | A | 8/2002 |
| CN | 102326030 | A | 1/2012 |
| CN | 202284847 | U | 6/2012 |
| JP | 1066053 | A | 4/1967 |
| JP | 62-118094 | A | 5/1987 |
| JP | 63-113198 | A | 5/1988 |
| JP | 2-203129 | A | 8/1990 |
| JP | 4-80533 | A | 3/1992 |
| JP | 7-42692 | A | 2/1995 |
| JP | 9-170770 | A | 6/1997 |
| JP | 9-229399 | A | 9/1997 |
| JP | 2002-61867 | A | 2/2002 |
| JP | 2002-195595 | A | 7/2002 |
| JP | 2002-286244 | A | 10/2002 |
| JP | 2005-77072 | A | 3/2005 |

OTHER PUBLICATIONS

International Search Report issued in PCT/JP2013/071820, dated Oct. 29, 2013.

* cited by examiner

AIR CONDITIONER

TECHNICAL FIELD

The present invention relates to an air conditioner including a cross flow fan.

BACKGROUND

A cross flow fan is a blower which extends in the axial direction and includes a plurality of vanes lined up in the rotational direction. In an air conditioner including this cross flow fan, a stabilizer and a rear guider are provided to oppose the outer periphery of the fan, respectively. The stabilizer is termed a front tongue portion, whereas a part of the rear guider which part extends from the leading end portion to the portion closest to the fan is termed a rear tongue portion. These tongue portions form an air passage on the blow-out side of the fan. Between each tongue portion and the fan, a vortex airflow is generated. When a vane of the fan passes this vortex airflow, wind noise (NZ noise) is generated on account of the interference between the vortex airflow and the vane.

To suppress this wind noise, for example, Patent Document 1 teaches that a rib protruding toward the fan is provided at the leading end portion of the front tongue portion (stabilizer). The rib is arranged on the fan side such that the edge (which is closest to the fan) of the surface is corrugated to have apexes which are deviated from one another in the direction of the rotation. With this arrangement, the edge of one vane does not simultaneously passes the apexes of the rib, and hence the generation of wind noise is temporally spread. In this way, the wind noise is suppressed.

CITATION LIST

Patent Document

[Patent Document 1] Japanese Unexamined Patent Publication No. 62-118094

SUMMARY OF INVENTION

Technical Problem

The air conditioner of Patent Document 1, however, is disadvantageous in that, while the generation of the wind noise is temporally dispersed, the shape of the rib is irregular across cross sections orthogonal to the axial direction, and hence the shape is not optimal for the air-blowing performance and the air-blowing performance (air-blowing efficiency and air amount) is deteriorated.

An object of the present invention is to provide an air conditioner in which wind noise is suppressed while the air-blowing performance is maintained.

Solution to Problem

According to the first aspect of the invention, an air conditioner includes: a cross flow fan which extends in an axial direction and includes vanes lined up in a circumferential direction and a stabilizer and a rear guider which are provided on respective sides of an outer periphery of the cross flow fan to form an air passage, at least one of the stabilizer and the rear guider including at least one twisted portion at least at a part in the axial direction of the at least one of the stabilizer and the rear guider, which part is on the leading end side, in the circumferential direction of the cross flow fan, the at least one twisted portion is deviated from the axial direction gradually from one end to the other end in the axial direction.

In this air conditioner, the twisted portion provided in a region including the leading end side of at least one of the rear guider and the stabilizer is deviated from the axial direction gradually in the circumferential direction. On this account, wind noise (NZ noise) is not generated at once when one vane passes the twisted portion, with the result that the wind noise is continuously generated (i.e., in a spread manner). On this account, the wind noise is suppressed.

In addition to the above, the twisted portion occupies a certain length from the leading end of the stabilizer or the rear guider. Because this twisted portion is deviated from the axial direction gradually in the circumferential direction, the shape of the twisted portion is substantially uniform across any cross section orthogonal to the axial direction. On this account, a generated airflow is substantially on the same level as an airflow generated in the case where the rear guider and the stabilizer linearly extend in parallel to the axial direction, and hence the deterioration of the air-blowing performance does not occur.

According to the second aspect of the invention, the air conditioner of the first aspect is arranged such that the at least one twisted portion is uniform in shape across any cross section orthogonal to the axial direction.

According to the third aspect of the invention, the air conditioner of the first or second aspect is arranged such that at least one of the stabilizer and the rear guider includes a plurality of the at least one twisted portions which are lined up in the axial direction, directions of deviation of the twisted portions in the circumferential direction are identical with one another in a direction from the one end to the other end in the axial direction.

In this air conditioner, because the twisted portions are lined up in, the axial direction, the degree of twist is high as compared to a case where a single twisted portion, the length of which in the axial direction is identical with the total length in the axial direction of the twisted portions, is provided. Furthermore, the twisted portions are provided in a range which is long in the axial direction.

In addition to the above, when two neighboring twisted portions are deviated in different directions along the circumferential direction, wind noise may be large at the border of these two twisted portions on account of interference. In this regard, the twisted portions are deviated in the same direction along the circumferential direction, and hence the wind noise does not become large.

According to the fourth aspect of the invention, the air conditioner of the third aspect is arranged such that, in the cross flow fan, vane wheels each including the vanes are lined up in the axial direction, the vanes of two neighboring vane wheels are deviated from one another in the circumferential direction, and a connecting portion connecting two neighboring twisted portions with each other is positioned to oppose a connecting portion connecting two neighboring vane wheels.

In this air conditioner, because the twisted portions are provided to oppose the respective vane wheels, wind noise is continuously generated by each of the vane wheels.

According to the fifth aspect of the invention, the air conditioner of the fourth aspect is arranged such that, in a direction from one end to the other end in the axial direction, a direction of deviation in the circumferential direction between end portions of two neighboring twisted portions which end portions oppose each other in the axial direction is identical with a direction of deviation in the circumferential direction between the vanes of two neighboring vane wheels.

In this air conditioner, the direction of deviation in the circumferential direction between the end portions of two neighboring twisted portions which end portions oppose each other in the axial direction is identical with the direction of deviation in the circumferential direction between the vanes of two neighboring vane wheels. On this account, at the border between neighboring vane wheels, two or more vanes do not simultaneously pass a vortex airflow generated between the rear guider or the stabilizer and the fan, with the result that the wind noise is suppressed. When the deviation angles in the circumferential direction of these two are identical, wind noise is continuously generated from one end to the other end in the axial of the fan. This further suppresses the wind noise.

According to the sixth aspect of the invention, the air conditioner of the fifth aspect is arranged such that a deviation angle in the circumferential direction between end portions of two neighboring twisted portions which end portions oppose each other in the axial direction is not smaller than 50% and not larger than 150% of a deviation angle in the circumferential direction between the vanes of two neighboring vane wheels.

In this air conditioner, when the deviation angle between the end portions of two neighboring twisted portions which end portions oppose each other in the axial direction is smaller than 50% of the deviation angle in the circumferential direction between the vanes of two neighboring vane wheels, the degree of twist is too small and hence the effect of suppression of wind noise is insufficient. In the meanwhile, when larger than 150%, at the border between neighboring vane wheels, a region where plural vanes simultaneously pass the vortex airflow generated between the rear guider or the stabilizer and the fan is large, and hence the effect of suppression of wind noise is insufficient. In the present invention, wind noise is sufficiently suppressed because the former angle is arranged to be not smaller than 50% and not larger than 150% of the latter angle.

According to the seventh aspect of the invention, the air conditioner of any one of the first to sixth aspects is arranged such that the at least one twisted portion is provided on the rear guider, and occupies a part between the closest position which is closest to the outer periphery of the cross flow fan and the leading end.

In this air conditioner, the twisted portion provided on the rear guider occupies the closest position where the rear guider is closest to the fan. Because wind noise is generated when a vane passes the closest position, continuous generation of wind noise is certainly achieved on account of the inclusion of the closest position in the twisted portion, and hence the wind noise is suppressed.

According to the eighth aspect of the invention, the air conditioner of any one of the first to seventh aspects is arranged such that the at least one twisted portion is provided on the stabilizer, and occupies the closest position which is closest to the outer periphery of the cross flow fan.

In this air conditioner, the twisted portion provided on the stabilizer occupies the closest position where the rear guider is closest to the fan. Because wind noise is generated when a vane passes the closest position, continuous generation of wind noise is certainly achieved on account of the inclusion of the closest position in the twisted portion, and hence the wind noise is suppressed.

According to the ninth aspect of the invention, the air conditioner of the seventh aspect is arranged such that, in the at least one twisted portion in the rear guider, the part between the closest position and the leading end is shaped to bulge away from the cross flow fan.

In this air conditioner, the arrangement above stabilizes the vortex airflow generated between the rear guider and the fan, and further noise suppression is achieved.

According to the tenth aspect of the invention, the air conditioner of the eighth aspect is arranged such that, in the at least one twisted portions in the stabilizer, the part occupying the closest position is shaped to bulge away from the cross flow fan.

In this air conditioner, the arrangement above stabilizes the vortex airflow generated between the rear guider and the fan, and further noise suppression is achieved.

Advantageous Effects of Invention

As described above, the following effects are obtained by the present invention.

According to the first aspect of the invention, the twisted portion provided in a region including the leading end side of at least one of the rear guider and the stabilizer is deviated from the axial direction gradually in the circumferential direction. On this account, wind noise (NZ noise) is not generated at once when one vane passes the twisted portion, with the result that the wind noise is continuously generated (i.e., in a spread manner). On this account, the wind noise is suppressed.

In addition to the above, the twisted portions occupy a certain length from the leading end of the stabilizer or the rear guider. Because this twisted portion is deviated from the axial direction gradually in the circumferential direction, the shape of the twisted portion is substantially uniform across any cross section orthogonal to the axial direction. On this account, a generated airflow is substantially on the same level as an airflow generated in case where the rear guider and the stabilizer linearly extend in parallel to the axial direction, and hence the deterioration of the air-blowing performance does not occur.

According to the third aspect of the invention, because the twisted portions are lined up in the axial direction, the degree of twist is high as compared to a case where a single twisted portion, the length of which in the axial direction is identical with the total length in the axial direction of the twisted portions, is provided. Furthermore, the twisted portion is provided in a range which is long in the axial direction. In addition to the above, when two neighboring twisted portions are deviated in different directions along the circumferential direction, wind noise may be large at the border of these two twisted portions on account of interference. In this regard, the twisted portions are deviated in the same direction along the circumferential direction, and hence the wind noise does not become large.

According to the fourth aspect of the invention, because the twisted portions are provided to oppose the respective vane wheels, wind noise is continuously generated by each of the vane wheels.

According to the fifth aspect of the invention, the direction of deviation in the circumferential direction between the end portions of two neighboring twisted portions which end portions oppose each other in the axial direction is identical with the direction of deviation in the circumferential direction between the vanes of two neighboring vane wheels. On this account, at the border between neighboring vane wheels, two or more vanes do not simultaneously pass a vortex airflow generated between the rear guider or the stabilizer and the fan, with the result that the wind noise is suppressed. When the deviation angles in the circumferential direction of these two are identical, wind noise is continuously generated from one end to the other end in the axial of the fan. This further suppresses the wind noise.

According to the sixth aspect of the invention, when the deviation angle between the end portions of two neighboring twisted portions which end portions oppose each other in the axial direction is smaller than 50% of the deviation angle in the circumferential direction between the vanes of two neighboring vane wheels, the degree of twist is too small and hence the effect of suppression of wind noise is insufficient. In the meanwhile, when larger than 150%, at the border between neighboring vane wheels, a region where plural vanes simultaneously pass the vortex airflow generated between the rear guider or the stabilizer and the fan is large, and hence the effect of suppression of wind noise is insufficient. In the present invention, wind noise is sufficiently suppressed because the former angle is arranged to be not smaller than 50% and not larger than 150% of the latter angle.

According to the seventh aspect of the invention, the twisted portion provided on the rear guider occupies the closest position where the rear guider is closest to the fan. Because wind noise is generated when a vane passes the closest position, continuous generation of wind noise is certainly achieved on account of the inclusion of the closest position in the twisted portion, and hence the wind noise is suppressed.

According to the eighth aspect of the invention, the twisted portion provided on the stabilizer occupies the closest position where the rear guider is closest to the fan. Because wind noise is generated when a vane passes the closest position, continuous generation of wind noise is certainly achieved on account of the inclusion of the closest position in the twisted portion, and hence the wind noise is suppressed.

According to the ninth aspect of the invention, the arrangement above stabilizes the vortex airflow generated between the rear guider and the fan, and further noise suppression is achieved.

According to the tenth aspect of the invention, the arrangement above stabilizes the vortex airflow generated between the rear guider and the fan, and further noise suppression is achieved.

DESCRIPTION OF EMBODIMENTS

Figure 1:
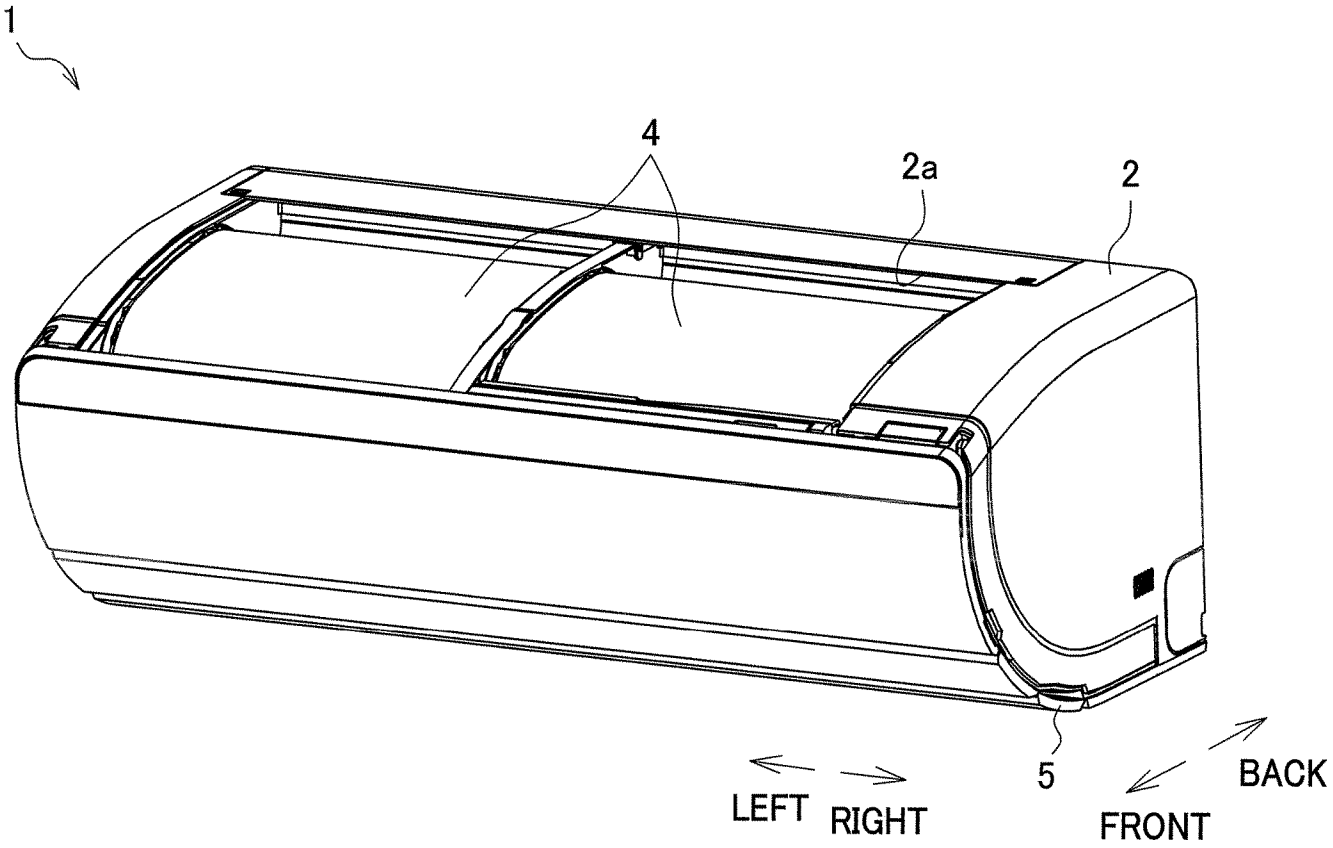
FIG. 1 is an oblique perspective of the external appearance of an indoor unit of an air conditioner of an embodiment of the present invention.

The following will describe an embodiment of the present invention. As shown in FIG. 1, an indoor unit 1 of an air conditioner of the present embodiment is as a whole narrow and long in one direction in shape, and is attached to a wall of a room so that the length of the air conditioner is horizontal. The indoor unit 1 and an unillustrated outdoor unit constitute the air conditioner which cools or warms the room. Hereinafter, a direction of protrusion from the wall to which the indoor unit 1 is attached will be referred to as "frontward", whereas the direction opposite to the frontward will be referred to as "backward". Furthermore, the left-right direction in FIG. 1 will be simply referred to as "left-right direction".

Figure 2:
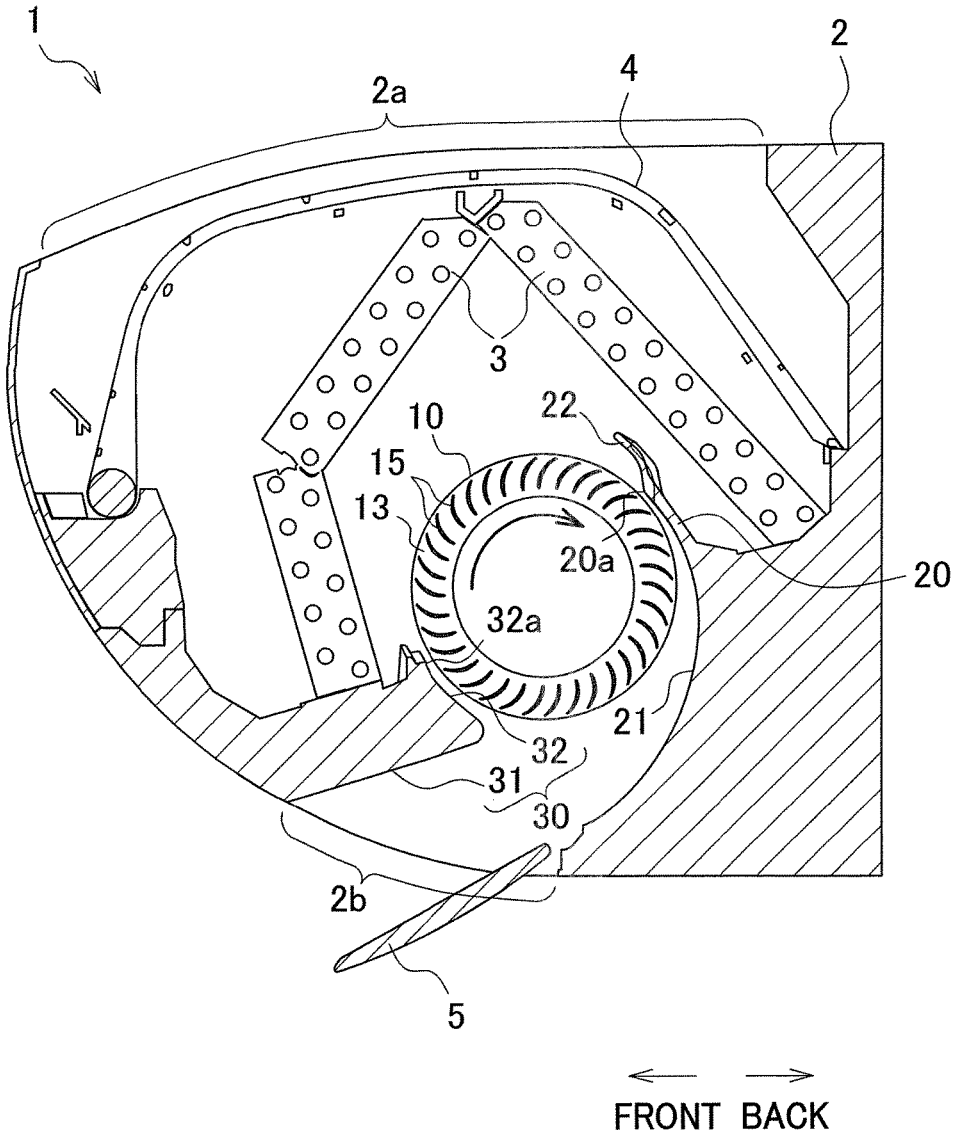
FIG. 2 is a cross section of the indoor unit.

As shown in FIG. 2, the indoor unit 1 includes a casing 2 and internal devices stored in the casing 2 such as a heat exchanger 3, a cross flow fan 10, a filter 4, and an electronic component box (not illustrated). Through the upper surface of the casing 2 is formed an inlet port 2*a*, whereas through the lower surface of the casing 2 is formed an outlet port 2*b*. In the vicinity of the outlet port 2*b*, a horizontal flap 5 is provided for adjusting the wind direction in the up-down direction and for opening and closing the outlet port 2*b*.

The cross flow fan 10 (hereinafter, this will be simply referred to as a fan 10) is disposed so that its axial direction is in parallel to the left-right direction. This fan 10 rotates in the direction indicated by the arrow in FIG. 2. To the front and to the back of the fan 10, a front guider 30 and a rear guider (rear tongue portion) 20 are provided, respectively, to form an air passage. A substantial upper half of the front guider 30 is constituted by a stabilizer (front tongue portion) 32. As the stabilizer 32 and the rear guider 20 are provided on the respective sides of the fan 10, the fan 10 sucks air from the upper front and blows out the air downward and backward. The heat exchanger 3 is disposed to surround the front side and the upper side of the fan 10. In an air conditioning operation, the fan 10 is driven so that indoor air is sucked through the inlet port 2*a*, and the sucked air is heated or cooled in the heat exchanger 3 and is then blown out through the outlet port 2*b*.

The following will detail the fan 10, the rear guider 20, and the front guider 30.

[Fan]

Figure 3:
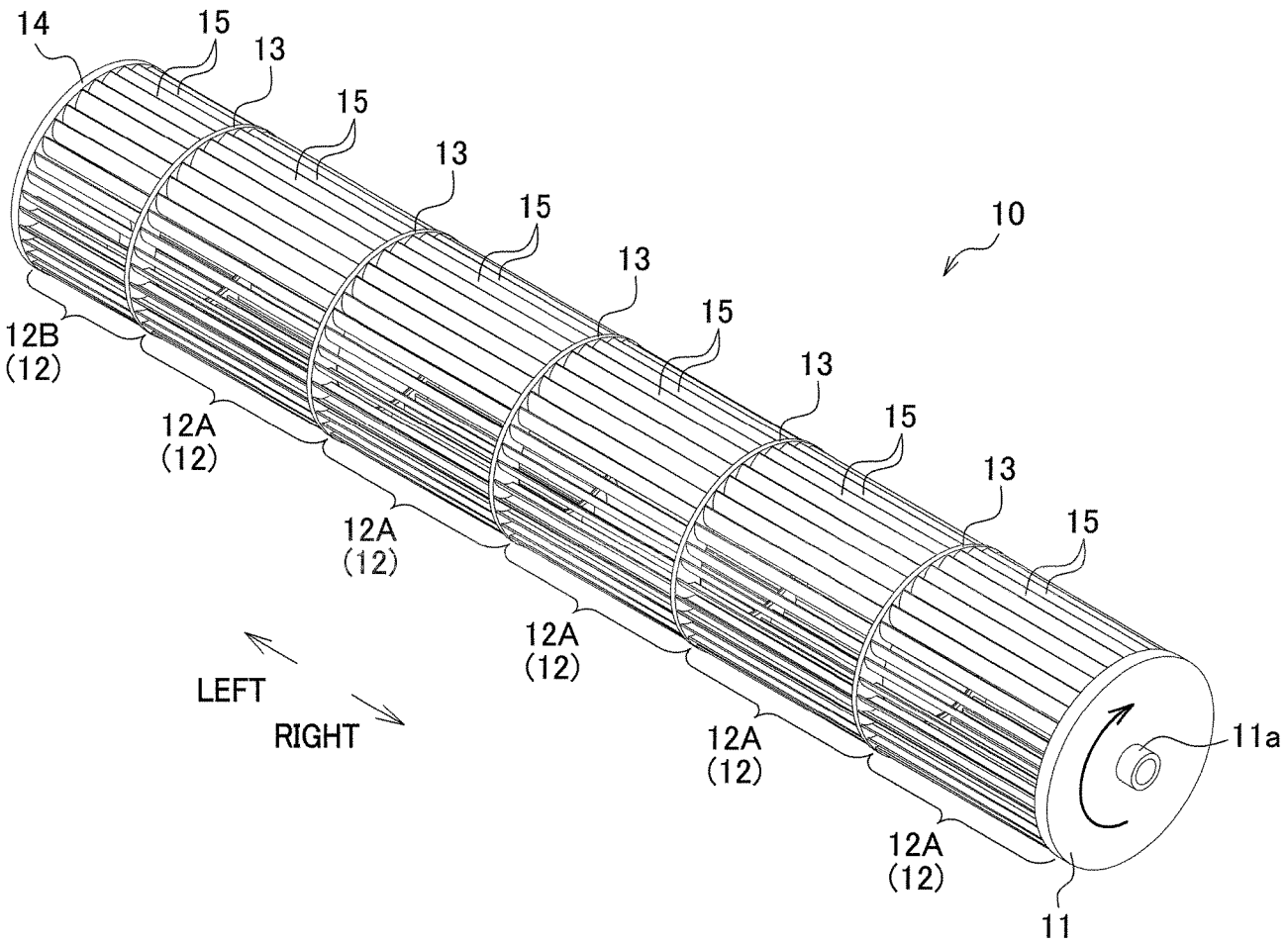
FIG. 3 is an oblique perspective of a cross flow fan.

As shown in FIG. 3, the fan 10 is constituted by a plurality of (six in the present embodiment) vane wheels 12 lined up in the axial direction (left-right direction) and an end plate 11.

The end plate 11 constitutes the right end portion of the fan 10. From a central portion of the right surface of the end plate 11, a boss portion 11*a* protrudes to be connected with the rotational axis of a motor (not illustrated) for driving the fan 10.

Among the six vane wheels 12, each of the right five vane wheels 12A is made up of vanes 15 lined up in the circumferential direction and a substantially annular supporting plate 13 connected to the left ends of the vanes. The vanes 15 and the supporting plate 13 are integrally formed. The right end of each vane 15 of each vane wheel 12A is joined by welding or the like with the neighboring end plate 11 or the supporting plate 13 of the neighboring vane wheel 12A.

The leftmost vane wheel 12B among the six vane wheels 12 is made up of vanes 15 lined up in the circumferential direction and a substantially disc-shaped end plate 14 which is connected to the left ends of the vanes 15. The vanes 15 and the end plate 14 are integrally formed. The right end of each vane 15 of the vane wheel 12B is joined by welding or the like with the supporting plate 13 of the neighboring vane wheel 12A. From a central portion of the left surface of the end plate 14, a shaft (not illustrated) which is rotatably supported by a bearing attached to the casing 2 protrudes.

The vanes 15 of each vane wheel 12 extend in the axial direction (left-right direction), and each of which is disposed as a forward-swept wing at a predetermined blade angle. The lengths of the vanes 15 of each of the five vane wheels 12A are identical in the axial direction and is substantially twice as long as the lengths of the vanes 15 of the vane wheel 12B in the axial direction. In the present embodiment, the vanes 15 of each vane wheel 12 are lined up in the circumferential direction at irregular intervals. The intervals of the vanes 15 are identical between the six vane wheels 12. The vanes 15 may be lined up at regular intervals.

Figure 4:
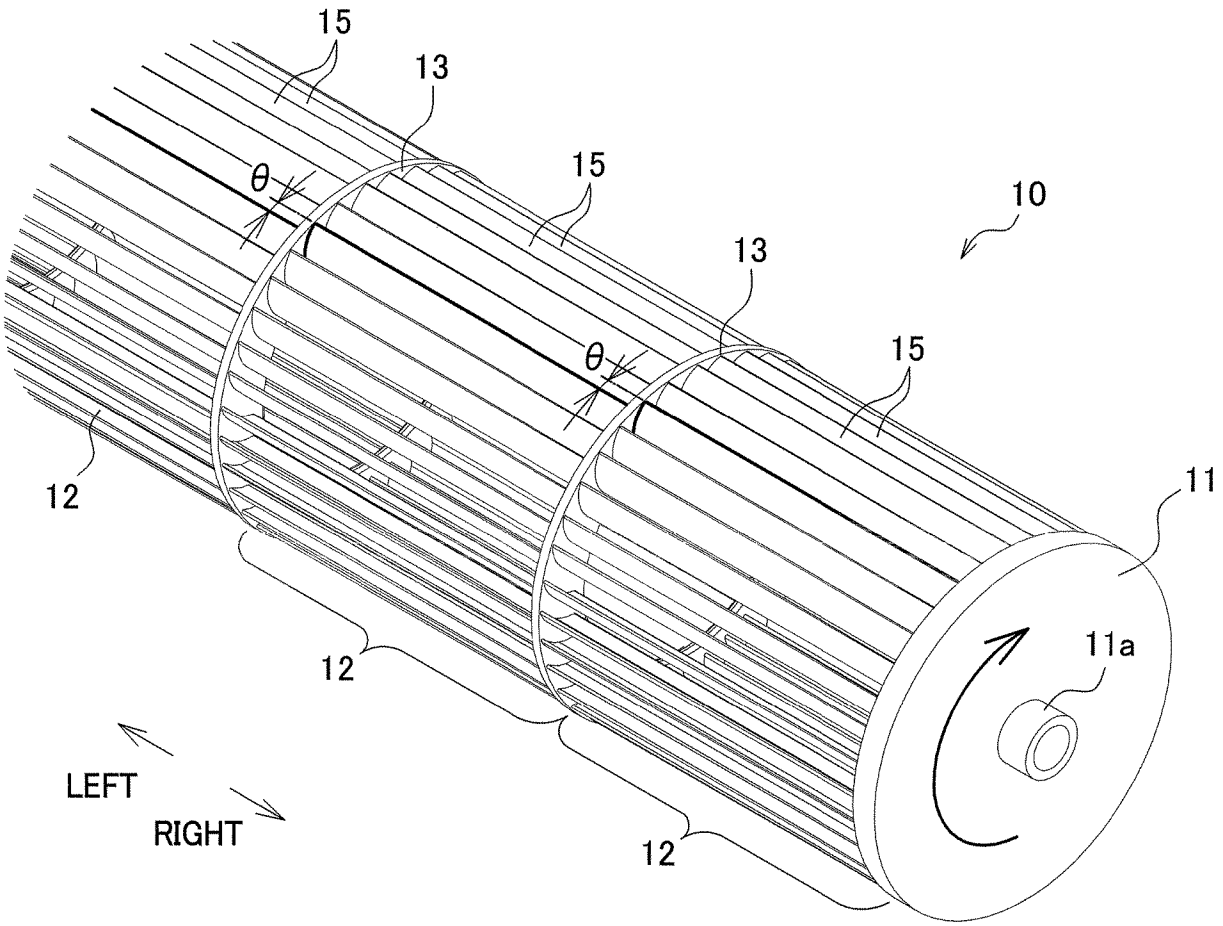
FIG. 4 is a partially-enlarged oblique perspective of the cross flow fan.

As shown in FIG. 4, the vanes 15 of one vane wheel 12 and the vanes 15 of the neighboring vane wheel 12 are deviated from one another in the circumferential direction. To be more specific, vanes 15 of any given vane wheel 12 are deviated from the vanes 15 of the vane wheel 12 immediately to the left of the any given vane wheel 12 each for an angle θ in the rotational direction (indicated by the arrow in FIG. 4). To put it differently, from the leftmost wheel 12 to the rightmost wheel 12 of the six vane wheels 12, each vane 15 is deviated from the corresponding vane 15 of the neighboring vane wheel 12 for the angle θ in the rotational direction.

[Rear Guider]

Figure 5:
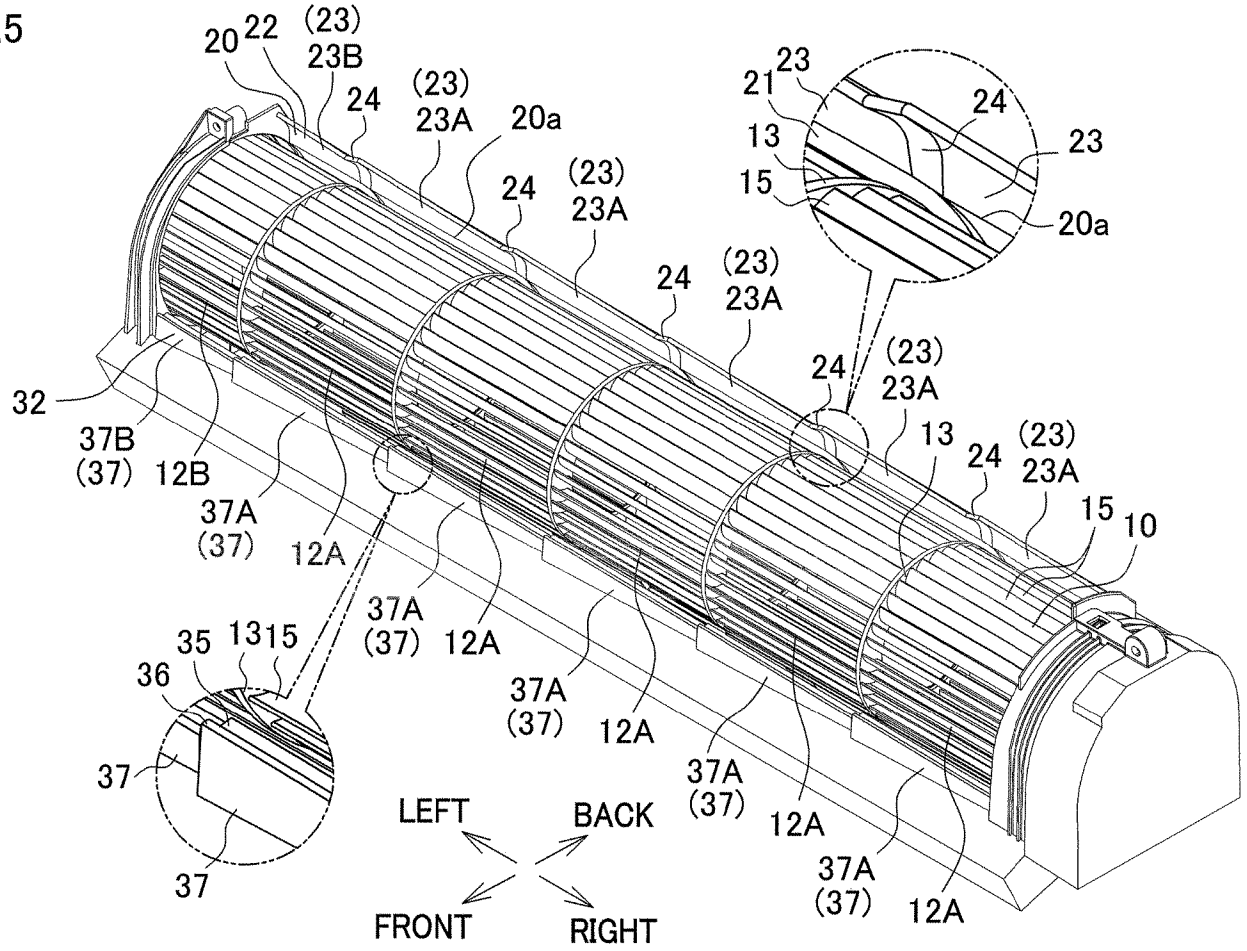
FIG. 5 is an oblique perspective of the cross flow fan and its surroundings in the indoor unit.
Figure 6:
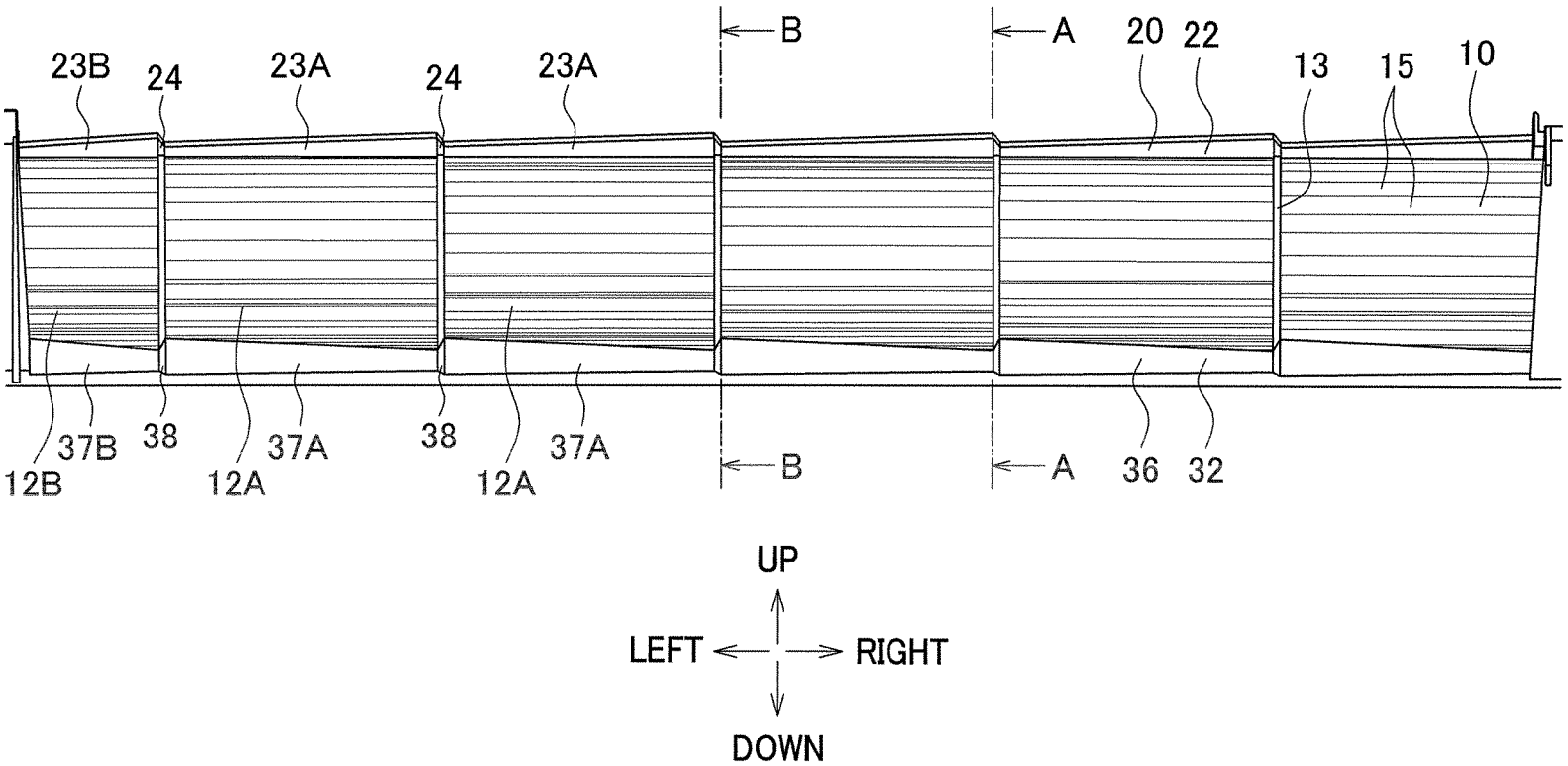
FIG. 6 is a front view of the cross flow fan and its surroundings in the indoor unit.
Figure 7:
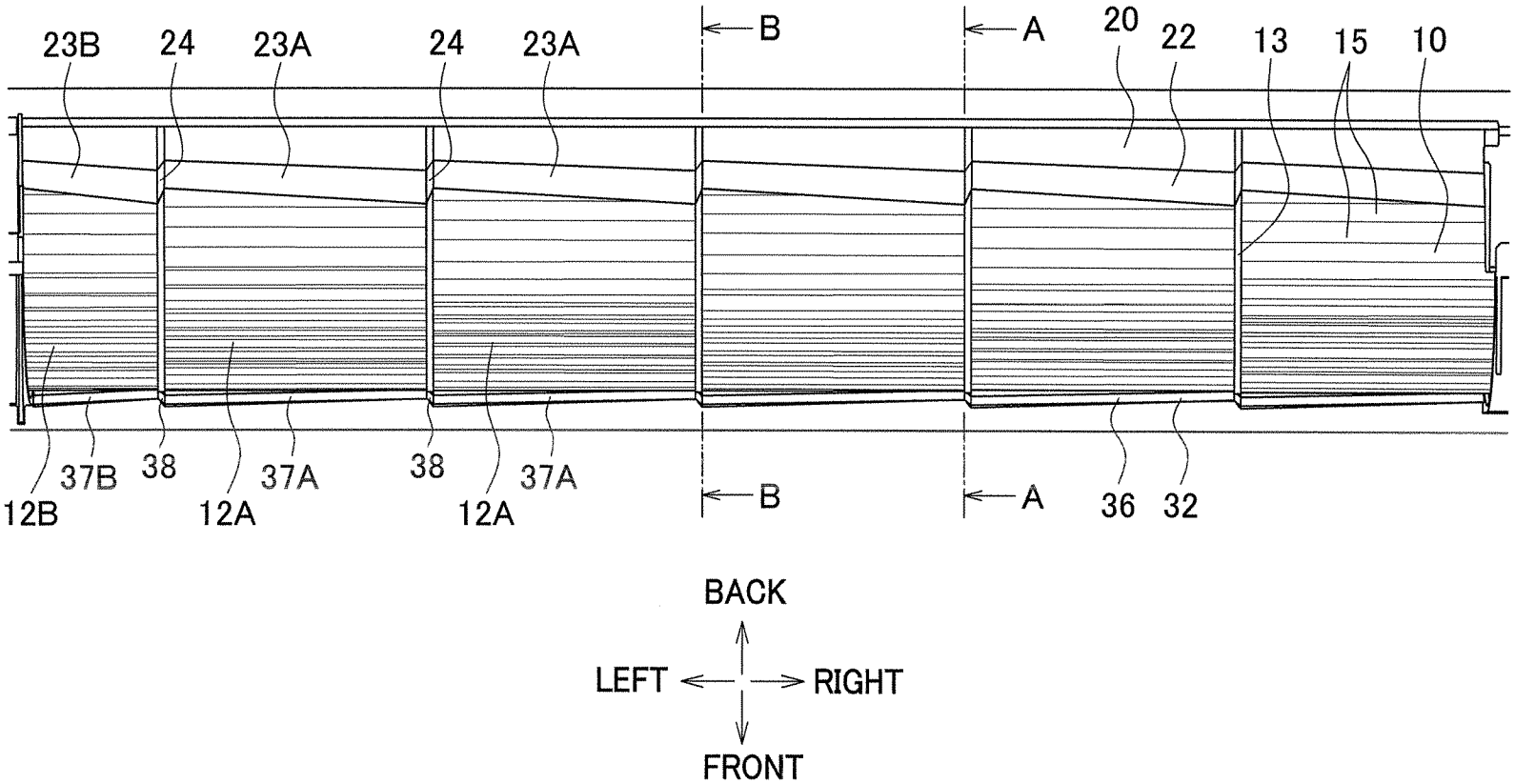
FIG. 7 is a front view of the cross flow fan and its surroundings in the indoor unit.

The rear guider 20 is provided to the back of the fan 10, and the lower edge of the rear guider 20 is connected to the outlet port 2*b* (see FIG. 2). As shown in FIG. 5 to FIG. 7, the length in the left-right direction of the rear guider 20 is substantially identical with the length in the left-right direction of the fan 10, and the rear guider 20 opposes substantially the entirety of the fan 10 in the left-right direction. Furthermore, as shown in FIG. 2 and FIG. 6, the upper edge of the rear guider 20 is slightly higher in position than the upper end of the fan 10.

As shown in FIG. 2, in the surface of the rear guider 20 which surface opposes the fan 10, a part which is not the upper and lower end portions is a curved surface 21 which is substantially arc-shaped. The distance (shortest distance) between the curved surface 21 and the outer periphery of the fan 10 decreases upward.

In addition to the above, the rear guider 20 includes a protruding portion 22 at a part above the curved surface 21 (i.e., to the leading end side of the curved surface 21). The protruding portion 22 is substantially arc-shaped and bulges in the direction away from the fan 10 in cross section taken at the line orthogonal to the left-right direction. As shown in FIG. 5 to FIG. 7, the protruding portion 22 is constituted by a plurality of (six in the present embodiment) twisted portions 23 lined up in the left-right direction and connecting portions 24 each provided between two neighboring twisted portions 23.

Each of the six twisted portions 23 is positioned to oppose the vane wheel 12. Among the six twisted portions 23, the right five twisted portions 23A are identical with one another in length in the left-right direction, and are substantially identical with the vanes 15 of the vane wheels 12A in length in the left-right direction. The length of the leftmost twisted portion 23B is substantially half as long as the length in the left-right direction of each twisted portion 23A, and is substantially identical with the length in the left-right direction of each of the vanes 15 of the vane wheel 12B.

Figure 8:
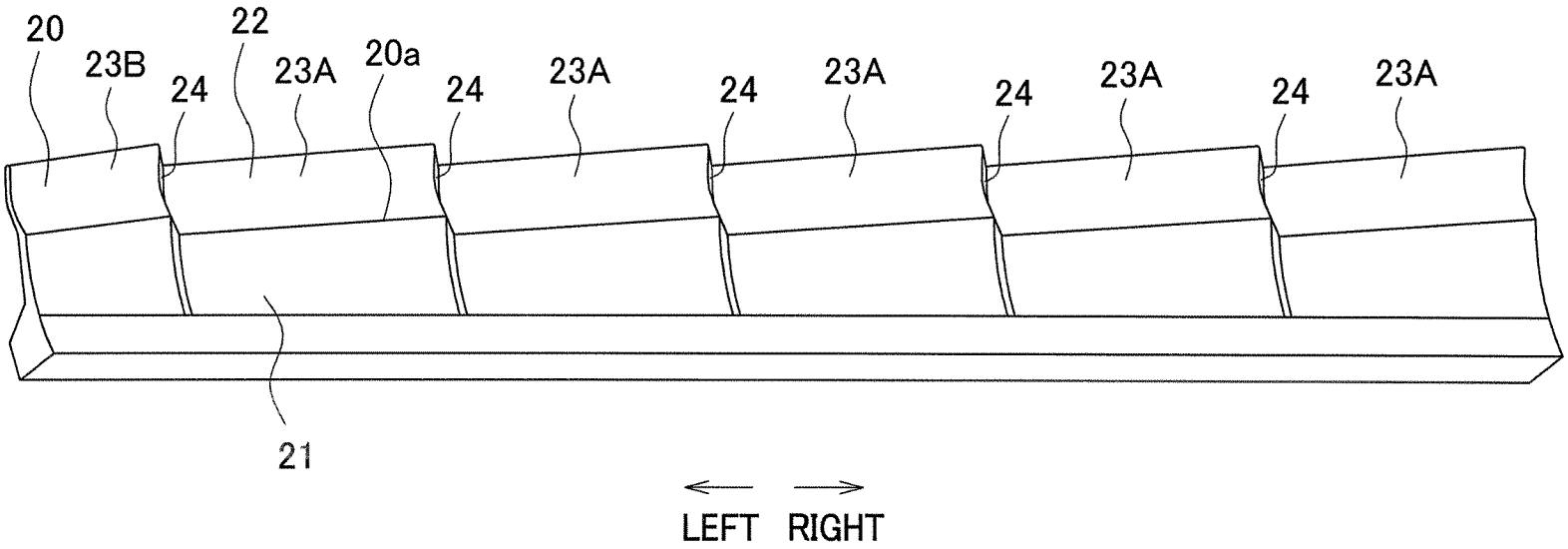
FIG. 8 is an oblique perspective of a part on the leading end side of a rear guider.

As shown in FIG. 8, in the circumferential direction of the fan 10, each twisted portion 23 is deviated from the axial direction of the fan 10 gradually from the left edge to the right edge. On this account, the shape of each twisted portion 23 is substantially uniform across any cross section orthogonal to the left-right direction. The six twisted portions 23 are identical with one another in the cross sectional shape in the direction orthogonal to the left-right direction. Furthermore, the highest ends of the six twisted portions 23 are at the same height and the lowest ends of the six twisted portions 23 are at the same height (see FIG. 6).

Figure 9B:
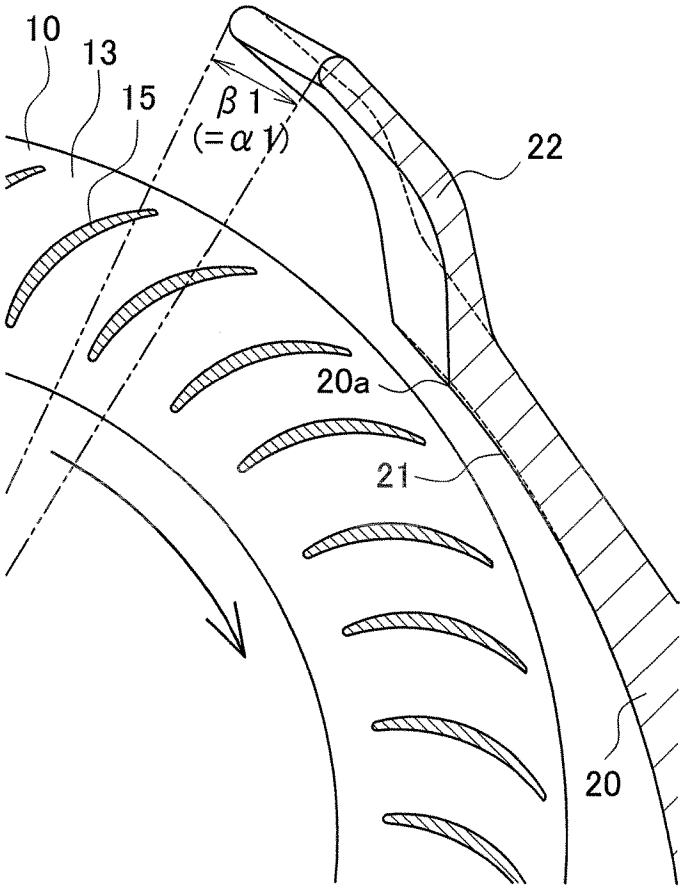
FIG. 9B is a partially-enlarged cross section of the leading end of the rear guider and its surroundings, which is taken at the B-B line in FIG. 6 and FIG. 7.
Figure 9A:
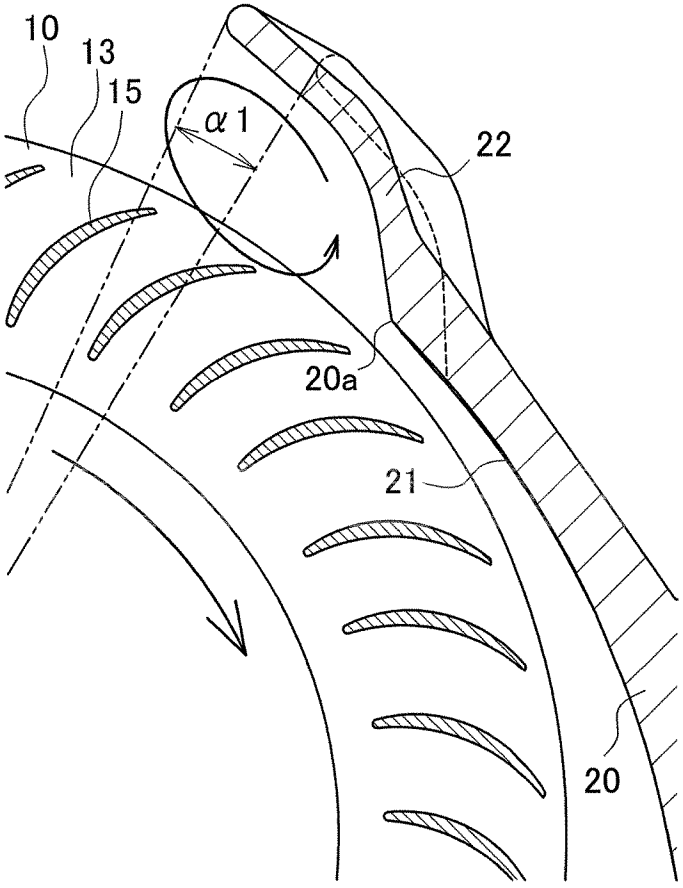
FIG. 9A is a partially-enlarged cross section of the leading end of the rear guider and its surroundings, which is taken at the A-A line in FIG. 6 and FIG. 7.

As shown in FIG. 9A, between the left edge and the right edge, each twisted portion 23 is deviated for an angle α1 in the direction opposite to the rotational direction (indicated by the arrow in FIG. 9) of the fan 10. The angles α1 of the deviation of the six twisted portions 23 are identical with one another.

In addition to the above, as shown in FIG. 9B, the left edge of one twisted portion 23 is deviated from the right edge of the twisted portion 23 neighboring to the left of that twisted portion 23 for an angle β1 in the rotational direction (indicated by the arrow in FIG. 9) of the fan 10. As such, the direction of deviation in the circumferential direction between the opposing end portions in the left-right direction of neighboring two twisted portions 23 is identical with the direction of the deviation in the circumferential direction between the vanes 15 of the two neighboring vane wheels 12. Furthermore, the angle β1 is identical with the angle α1. The angles α1 and β1 are preferably 50% to 150% of the deviation angle θ between the vanes 15 of the two neighboring vane wheels 12, and are more preferably identical with the angle θ.

As shown in FIG. 7 and the like, two neighboring twisted portions 23 are connected with each other by a connecting portion 24. Each of the connecting portions 24 is positioned to oppose the supporting plate 13 of the fan 10.

As shown in FIG. 9, the distance (shortest distance) between each twisted portion 23 (protruding portion 22) and the outer periphery of the fan 10 increases upward. As described above, because the distance (shortest distance) between the curved surface 21 and the outer periphery of the fan 10 decreases upward, the rear guider 20 is closest to the fan 10 at a border 20*a* (hereinafter, closest position 20*a*) between the lower edge of each twisted portion 23 (protruding portion 22) and the upper edge of the curved surface 21. Because the twisted portions 23 are arranged to be deviated in the circumferential direction, each of the closest positions 20*a* of the rear guider 20 is also deviated from the axial direction of the fan 10 in the circumferential direction of the fan 10 in the same manner as the corresponding twisted portion 23.

[Front Guider]

The front guider 30 is provided to the front of the fan 10, and the lower edge of the front guider 30 is connected to the outlet port 2*b* (see FIG. 2). The front guider 30 is made up of the stabilizer 32 provided to oppose the fan 10 and a front wall portion 31 which extends from the lower edge of the stabilizer 32 to the outlet port 2*b*.

As shown in FIG. 5 to FIG. 7, the length in the left-right direction of the stabilizer 32 is substantially identical with the length in the left-right direction of the fan 10, and the stabilizer 32 opposes substantially the entirety of the fan 10 in the left-right direction. Furthermore, as shown in FIG. 2 and FIG. 6, the upper edge of the stabilizer 32 is lower in position than the center of the fan 10.

As shown in FIG. 11, in the surface of the stabilizer 32 which surface opposes the fan 10, a part which is not the upper and lower end portions is a curved surface 33 which is substantially arc-shaped. The distance (shortest distance) between the curved surface 33 and the outer periphery of the fan 10 decreases upward.

The lower edge of the curved surface 33 is connected to a bending surface 34 which is substantially arc-shaped and curved in the direction opposite to the curving direction of the curved surface 33. The bending surface 34 constitutes the lower end portion of the stabilizer 32, and the front wall portion 31 extends downward and frontward from the lower edge of the bending surface 34.

In addition to the above, the stabilizer 32 includes a flat end face 35 which extends downward and frontward from the upper edge of the curved surface 33 and a convex portion 36 which is provided to the front of the end face 35 and protrudes upward from the end face 35. The convex portion 36 and the end face 35 constitute the upper end portion of the rear guider 20. The cross sectional shape of the convex portion 36 in the direction orthogonal to the left-right direction is substantially triangular.

The stabilizer 32 (including the convex portion 36, the end face 35, the curved surface 33, and the bending surface 34) is made up of plurality of (six in the present embodiment) twisted portions 37 lined up in the left-right direction and connecting portions 38 each of which is provided between two neighboring twisted portions 37.

The six twisted portions 37 are provided to oppose the vane wheels 12, respectively. Among the six twisted portions 37, the right five twisted portions 37A are identical with one another in length in the left-right direction, and are identical with the vanes 15 of the vane wheels 12A in length in the left-right direction. The length of the leftmost twisted portion 37B is substantially half as long as the length in the left-right direction of each twisted portion 23A, and is substantially identical with the length in the left-right direction of each of the vanes 15 of the vane wheel 12B.

Figure 10:
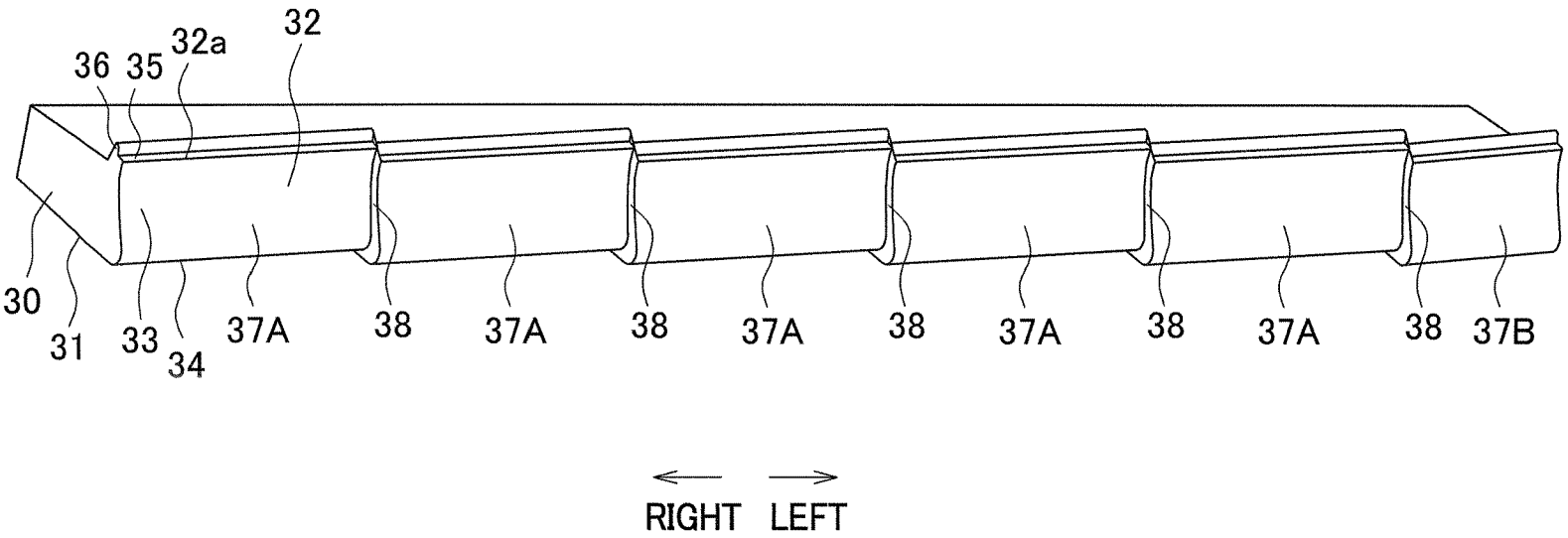
FIG. 10 is an oblique perspective of a front guider.

As shown in FIG. 10, in the circumferential direction of the fan 10, each twisted portion 37 is deviated from the axial direction of the fan 10 gradually from the left edge to the right edge. On this account, the shape of each twisted portion 37 is substantially uniform across any cross section orthogonal to the left-right direction. The six twisted portions 37 are identical with each other in cross sectional shape in the direction orthogonal to the left-right direction. Furthermore, the highest ends of the six twisted portions 37 are at the same height and the lowest ends of the six twisted portions 23 are at the same height (see FIG. 6).

Figure 11A:
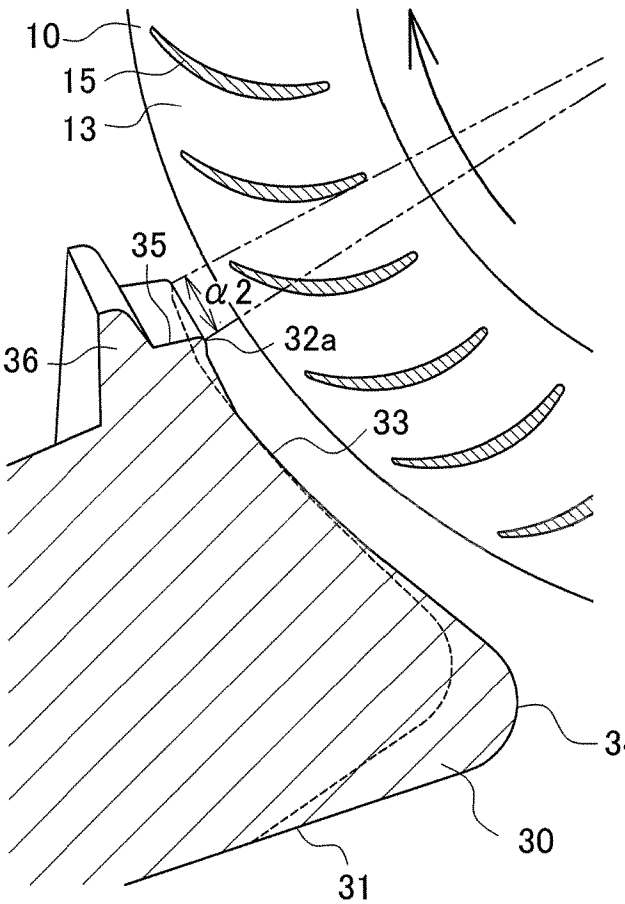
FIG. 11A is a partially-enlarged cross section of a stabilizer and its surroundings, which is taken at the A-A line in FIG. 6 and FIG. 7.

As shown in FIG. 11A, between the left edge and the right edge, each twisted portion 37 is deviated for an angle $\alpha 2$ in the direction opposite to the rotational direction (indicated by the arrow in FIG. 11) of the fan 10. The angles $\alpha 2$ of the deviation of the six twisted portions 37 are identical with one another.

Figure 11B:
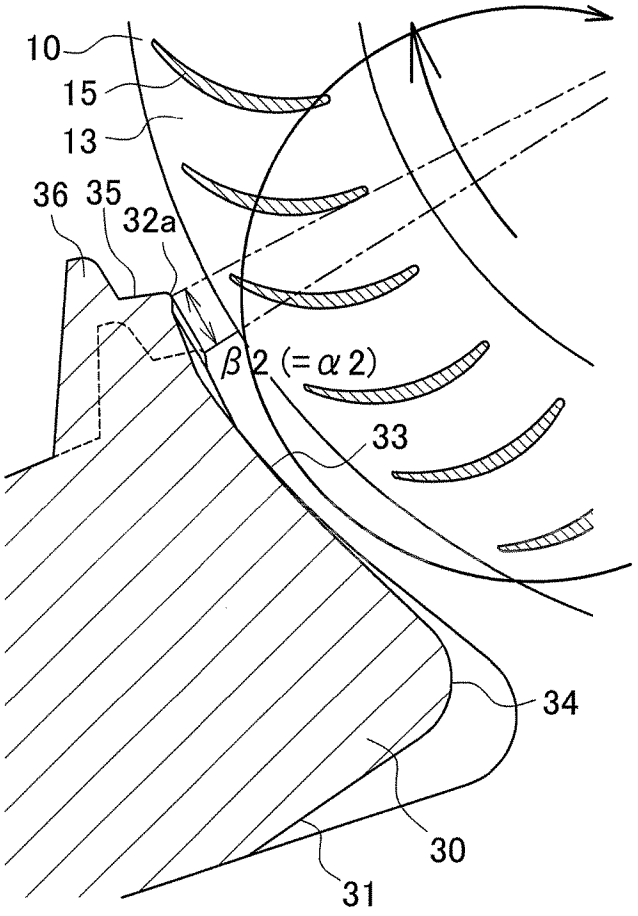
FIG. 11B is a partially-enlarged cross section of the stabilizer and its surroundings, which is taken at the B-B line in FIG. 6 and FIG. 7.

In addition to the above, as shown in FIG. 11B, the left edge of one twisted portion 37 is deviated from the right edge of the twisted portion 37 neighboring to the left of that twisted portion 37 for an angle $\beta 2$ in the direction of the rotational direction (indicated by the arrow in FIG. 11) of the fan 10. As such, the direction of the deviation in the circumferential direction between the opposing end portions in the left-right direction of neighboring two twisted portions 37 is identical with the direction of the deviation in the circumferential direction between the vanes 15 of the two neighboring vane wheels 12. Furthermore, the angle $\beta 2$ is identical with the angle $\alpha 2$. The angles $\alpha 2$ and $\beta 2$ are preferably 50% to 150% of the deviation angle $\theta$ between the vanes 15 of the two neighboring vane wheels 12, and are more preferably identical with the angle $\theta$.

As shown in FIG. 6 and the like, two neighboring twisted portions 37 are connected with each other by a connecting portion 38. Each of the connecting portions 38 is positioned to oppose the supporting plate 13 of the fan 10.

As shown in FIG. 11, the stabilizer 32 is closest to the outer periphery of the fan 10 at an upper edge 32*a* (hereinafter, closest position 32*a*) of the curved surface 33. Because the stabilizer 32 has the twisted portions 37 which are deviated in the circumferential direction, each of the closest positions 32*a* of the stabilizer 32 is also deviated in the circumferential direction of the fan 10 from left to right, in the same manner as the corresponding twisted portion 37.

Now, the wind noise generated between the rear guider 20 and the fan 10 will be described with reference to FIG. 12, with the help of an example in which the angle $\alpha 1$ al and the angle $\beta 1$ are identical with the angle $\theta$.

Figure 12:
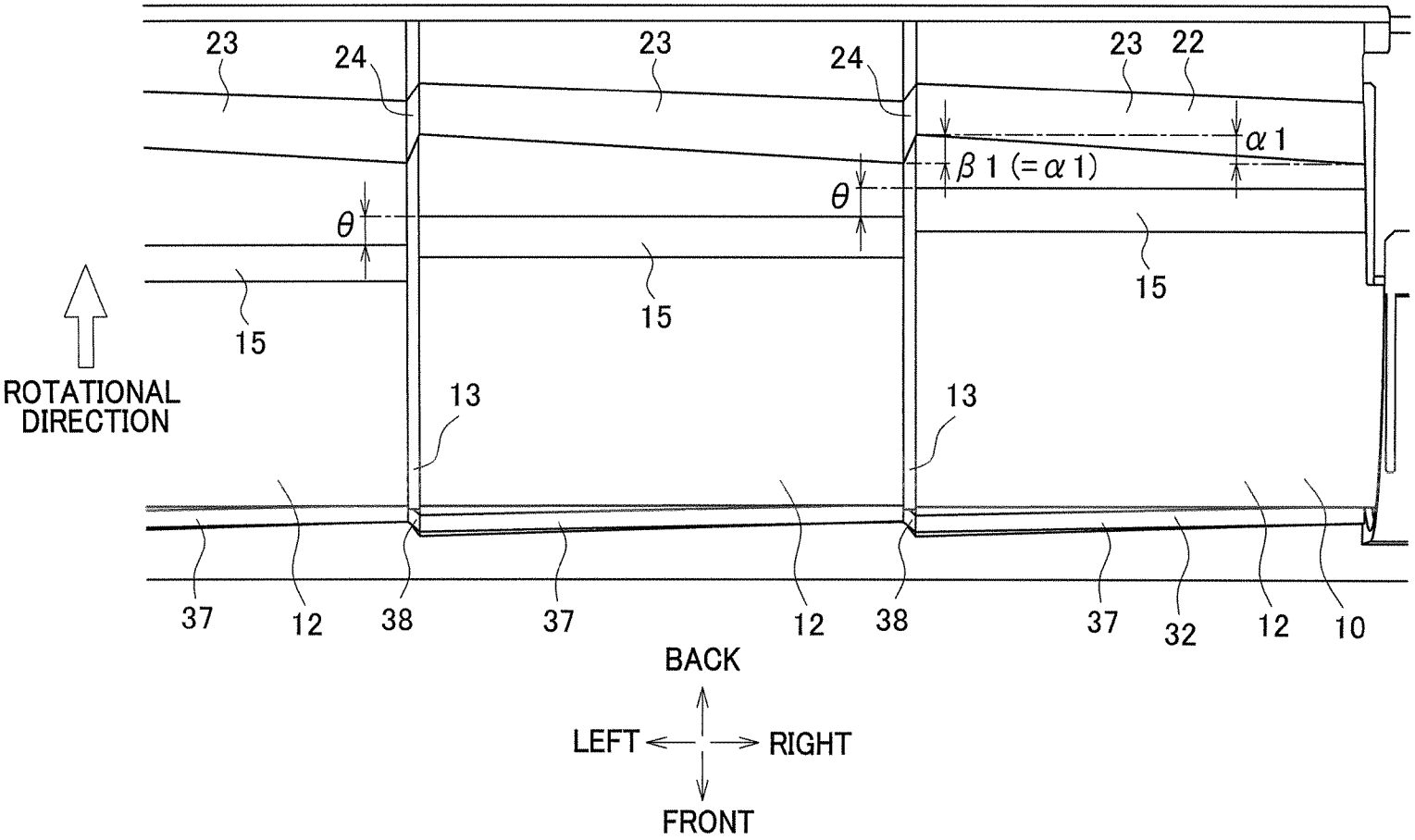
FIG. 12 is a partially-enlarged view of FIG. 7.

FIG. 12 shows only the right three vane wheels 12 among the six vane wheels 12. Furthermore, among the vanes 15 of these three vane wheels 12, the figure shows only three vanes 15 each of which is deviated from the left one in the rotational direction for the angle $\theta$.

When the fan 10 rotates, the rightmost vane 15 among the six vanes 15 each of which is deviated for the angle $\theta$ passes the twisted portion 23 first. This vane 15 passes across the closest position 20*a* of the twisted portion 23 from right to left. A vortex airflow (indicated by the arrow in FIG. 9) is generated between the leading end portion of the rear guider 20 and the fan 10, and wind noise is generated on account of the interference between this vortex airflow and the vanes. On this account, in the present embodiment, wind noise is continuously generated while one vane 15 passes across the edge of one twisted portion 23.

In addition to the above, at the same time as the left edge of the rightmost vane 15 passes the closest position 20*a* of the twisted portion 23, the right edge of the second rightmost vane 15 passes the closest position 20*a* of the second rightmost twisted portion 23. Thereafter, in the same manner as the first vane 15, the vanes 15 serially pass the closest positions 20*a* of the twisted portions 23, respectively, from right to left. On this account, at the same time as the wind noise generated by one vane 15 stops, the next wind noise is generated by the vane 15 which is to the left of the one vane 15 and is deviated for the angle $\theta$. In a similar manner, the remaining four vanes 15 serially passes the closest positions 20*a* of the twisted portions 23 from right to left. For this reason, wind noise is continuously generated as the six vanes 15 each deviated for the angle $\theta$ pass the leading end portion of the rear guider 20.

In addition to the above, a vortex airflow (indicated by the arrow in FIG. 11B) is generated between the curved surface 33 of the stabilizer 32 and the fan 10, too, and wind noise is generated on account of the interference between the vortex airflow and the vanes 15 when the vanes 15 pass the curved surface 33 of the stabilizer 32. On this account, in the present embodiment, wind noise is continuously generated while one vane 15 passes across the edge of one twisted portion 37 of the stabilizer 32. Furthermore, when the angle α2 and the angle β2 are identical with the angle θ, wind noise is continuously generated as the six vanes 15 each deviated for the angle θ pass the leading end portion of the stabilizer 32.

As described above, in the air conditioner of the present embodiment, the twisted portions 23 provided at the leading end portion of the rear guider 20 and the twisted portions 37 provided on the stabilizer 32 are each deviated in the circumferential direction from the left edge to the right edge. On this account, wind noise is not generated at once when one vane 15 passes the twisted portion 23 or 37, with the result that the wind noise is continuously generated. On this account, the wind noise is suppressed.

In addition to the above, the twisted portions 23 and 37 occupy a certain length from the leading ends of the rear guider 20 and the stabilizer 32, and are each deviated in the circumferential direction from the left edge to the right edge. For this reason, the shape of each twisted portion 23 or 37 is substantially uniform across any cross section orthogonal to the left-right direction. On this account, a generated airflow is substantially on the same level as an airflow generated in case where the rear guider and the stabilizer linearly extend in parallel to the left-right direction, and hence the deterioration of the air-blowing performance does not occur.

In the present embodiment, each of the rear guider 20 and the stabilizer 32 includes the six twisted portions 23 or 37 which are lined up in the left-right direction. Assume that, instead of the six twisted portions, a single twisted portion, the length of which in the left-right direction is identical with the total length in the left-right direction of the six twisted portions, is provided. In such a case, the positions of the left and right end portions of each of the protruding portion 22 and the stabilizer 32 are significantly different from each other in the circumferential direction, with the result that the airflow on the left and the airflow on the right are significantly imbalanced, or the degree of twist is extremely low and hence the effect of the suppression of wind noise is insufficient. In this regard, in the present embodiment, because plural twisted portions 23 and 37 are provided, the degree of twist is high while the positions in the circumferential direction of the protruding portion 22 or the stabilizer 32 are balanced in regard to the left-right direction. Furthermore, the twisted portions 23 and 37 are provided in ranges which are long in the left-right direction.

In addition to the above, when two neighboring twisted portions are deviated in different directions along the circumferential direction, wind noise may be large at the border of these two twisted portions on account of interference. In this regard, in the present embodiment, the six twisted portions 23 of the rear guider 20 and the six twisted portions 37 of the stabilizer 32 are deviated in the same direction along the circumferential direction, and hence the wind noise does not become large.

In addition to the above, because in the present embodiment the twisted portions 23 and 37 are provided to oppose the respective vane wheels 12, wind noise is continuously generated by each of the vane wheels 12.

In addition to the above, in the present embodiment, the direction of deviation in the circumferential direction between the end portions of two neighboring twisted portions 23 which end portions oppose each other in the left-right direction and the direction of deviation in the circumferential direction between the end portions of two neighboring twisted portions 37 which end portions oppose each other in the left-right direction are identical with the direction of deviation in the circumferential direction between the vanes 15 of two neighboring vane wheels 12. On this account, at the border between neighboring vane wheels 12, two or more vanes 15 do not simultaneously pass a vortex airflow generated between the rear guider 20 or the stabilizer 32 and the fan 10, with the result that the wind noise is suppressed.

When the deviation angle β1 between the end portions of two neighboring twisted portions 23 which end portions oppose each other in the left-right direction or the deviation angle β2 between the end portions of two neighboring twisted portions 37 which end portions oppose each other in the left-right direction is smaller than 50% of the deviation angle θ in the circumferential direction between the vanes 15 of two neighboring vane wheels 12, the degree of twist is too small and hence the effect of suppression of wind noise is insufficient. In the meanwhile, when larger than 150%, at the border between neighboring vane wheels, a region where plural vanes simultaneously pass the vortex airflow is large, and hence the effect of suppression of wind noise is insufficient. In the present embodiment, wind noise is sufficiently suppressed because the former angles are arranged to be not smaller than 50% and not larger than 150% of the latter angle.

When the angle β1 or the angle β2 is identical with the angle θ, wind noise is continuously generated from one end to the other end in the left-right direction of the fan 10. This further suppresses the wind noise.

In addition to the above, in the present embodiment each twisted portion 23 or 37 occupies the closest position 20*a* or 32*a* where the rear guider 20 or the stabilizer 32 is closest to the fan 10. Because wind noise is generated when a vane 15 passes a vortex airflow generated in the vicinity of the closest position 20*a* or 32*a*, continuous generation of wind noise is certainly achieved on account of the inclusion of the closest position 20*a* or 32*a* in each of the twisted portions 23 and 37, and hence the wind noise is suppressed.

In addition to the above, in the present embodiment, each twisted portion 23 of the rear guider 20 is arc-shaped to bulge away from the fan 10. This stabilizes the vortex airflow generated between the rear guider 20 and the fan 10, and further noise suppression is achieved.

While the embodiment of the present invention has been described, it should be noted that the scope of the invention is not limited to the above-described embodiment. The scope of the present invention is defined by the appended claims rather than the foregoing description of the embodiment, and the present invention is intended to embrace all alternatives, modifications and variances which fall within the scope of the appended claims. It is noted that the modifications below may be suitably combined and implemented.

While in the embodiment above the deviation angles α1 in the circumferential direction of the twisted portions 23 of the rear guider 20 are all identical, the deviation angles may be different from one another. In such a case, the five angles β1 in the rear guider 20 are different from one another. In a similar manner, the deviation angles α2 in the circumferential direction of the twisted portions 23 of the stabilizer 32 may be different from one another.

In the embodiment above, the direction of deviation in the circumferential direction between the end portions of two neighboring twisted portions 23 of the rear guider 20 which end portions oppose each other in the left-right direction is identical with the direction of deviation in the circumferential direction between the vanes 15 of two neighboring vane wheels 12. In this regard, the directions of deviation may be opposite to each other.

The same holds true for, the direction of deviation between two neighboring twisted portions 37 of the stabilizer 32.

While in the embodiment above the twisted portions 23 of the rear guider 20 are deviated in the same direction along the circumferential direction, the twisted portions 23 may be deviated in different directions. For example, twisted portions which are deviated from left to right in the direction opposite to the rotational direction and twisted portions which are each deviated from left to right in the rotational direction are alternately provided in the left-right direction. Furthermore, for example, among the six twisted portions, each of the right three twisted portions is deviated from left to right in the direction opposite to the rotational direction, whereas each of the remaining three twisted portions is deviated from left to right in the rotational direction. In similar manners, the twisted portions 37 of the stabilizer may be deviated in different directions along the circumferential direction.

In the embodiment above, the number of the twisted portions 23 of the rear guider 20 is identical with the number of vane wheels 12 of the fan 10, and a connecting portion 24 connecting neighboring twisted portions 23 with each other is provided to oppose the supporting plate 13. The disclosure, however, is not limited to this arrangement. The number of the twisted portions 23 of the rear guider 20 may be larger than or smaller than the number of the vane wheels 12. Furthermore, the length in the left-right direction of one twisted portion 23 may not be identical with the length in the left-right direction of the vane wheel 12. Furthermore, each connecting portion 24 may not be provided to oppose the supporting plate 13. The same holds true for the twisted portions 37 and the connecting portions 38 of the stabilizer 32.

While in the embodiment above two neighboring twisted portions 23 are connected with each other by a connecting portion 24, such a connecting portion 24 may not be provided and end portions of two neighboring twisted portions 23 which end portions oppose each other in the axial direction may be directly connected with each other.

While in the embodiment above the twisted portions 23 are formed across the almost entirety of the rear guider 20 in the left-right direction, one or plural twisted portion 23 may be formed only at a part in the left-right direction of the rear guider 20. In such a case, for example, the part in the left-right direction, where no twisted portion 23 is formed, extends in the left-right direction.

In a similar manner, in the stabilizer 32, a twisted portion 37 may be formed only at a part in the left-right direction of the stabilizer 32.

While in the embodiment above the part of the rear guider 20 where the shape is deviated in the circumferential direction ranges from the leading end to the border between the protruding portion 22 and the curved surface 21, the deviated part of the rear guider 20 may range from the leading end to an intermediate part of the curved surface 21. In other words, the lower edge of each twisted portion 23 may not be the border between the protruding portion 22 and the curved surface 21.

While in the embodiment above the entirety in the up-down direction of the stabilizer 32 is deviated in the circumferential direction, only a part of the stabilizer 32 on the leading end side may be deviated in the circumferential direction. In other words, the lower edge of each twisted portion 37 may not correspond to the lower edge of the stabilizer 32. For example, only the end face 35 and the convex portion may be deviated in the circumferential direction. Alternatively, for example, a part of the stabilizer 32 which part ranges from the leading end to an intermediate part of the curved surface 33 may be deviated in the circumferential direction.

While in the embodiment above both of the rear guider 20 and the stabilizer 32 have the twisted portions 23 and 37, only one of the rear guider 20 and the stabilizer 32 have twisted portions.

In the embodiment above, the cross sectional shape of the rear guider 20 in the direction orthogonal to the left-right direction is constituted by the arc-shaped curved surface 21 and the protruding portion 22 which is substantially arc-shaped in cross section and above the curved surface 21. The cross sectional shape of the rear guider may be different from this shape. For example, the cross sectional shape may be arranged such that a protruding portion which is substantially arc-shaped on the fan 10 side and is flat on the side opposite to the fan 10 is formed above the curved surface 21. When the cross sectional shape of the rear guider is different from the shape described in the embodiment above, at least a part of the rear guider which part ranges from the closest position where the rear guider is closest to the fan 10 to the leading end is deviated in the circumferential direction (i.e., a twisted portion).

In the embodiment above, the cross sectional shape of the stabilizer 32 in the direction orthogonal to the left-right direction is arranged such that the flat end face 35 and the convex portion 36 substantially triangular in cross section are provided above the curved surface 33. The cross sectional shape of the stabilizer may be different from this shape. For example, in the cross sectional shape, no end face 35 is provided and the convex portion 36 is connected to the upper edge of the curved surface 33. When the cross sectional shape of the stabilizer is different from the shape described in the embodiment above, at least a part of the stabilizer which part ranges from the closest position where the stabilizer is closest to the fan 10 to the leading end is deviated in the circumferential direction (i.e., a twisted portion).

While the embodiment above describes a case where the present invention is employed in a wall-mounted indoor unit which is arranged to suck indoor air from an upper part of the indoor unit and blow out the air from a lower part of the indoor unit, the present invention may be applicable to other purposes. For example, the present invention may be employed in a floor-mounted indoor unit which is arranged to suck indoor air from a lower part of the indoor unit and blow out the air from an upper part of the indoor unit.

INDUSTRIAL APPLICABILITY

The present invention makes it possible to suppress wind noise while maintaining an air-blowing performance.

REFERENCE SIGNS LIST

1 INDOOR UNIT OF AIR CONDITIONER
10 CROSS FLOW FAN
12 (12A, 12B) VANE WHEEL
15 VANE
20 REAR GUIDER
20*a* CLOSEST POSITION
22 PROTRUDING PORTION
23 (23A, 23B) TWISTED PORTION
24 CONNECTING PORTION
30 FRONT GUIDER
32 STABILIZER

32*a* CLOSEST POSITION
37 (37A, 37B) TWISTED PORTION
38 CONNECTING PORTION

The invention claimed is:

1. An air conditioner comprising:

a cross flow fan which extends in an axial direction and includes vanes lined up in a circumferential direction; and a stabilizer and a rear guider which are provided on respective sides of an outer periphery of the cross flow fan to form an air passage, at least one of the stabilizer and the rear guider including a plurality of twisted portions lined up in the axial direction, the plurality of twisted portions being provided at least at a part in the axial direction of the at least one of the stabilizer and the rear guider and at a leading end in the circumferential direction of the at least one of the stabilizer and the rear guider, each of the plurality of twisted portions is deviated from the axial direction, gradually increasing in the circumferential direction, from one end of the twisted portion to an other end thereof in the axial direction.

2. The air conditioner according to claim 1, wherein, each of the plurality of twisted portions is uniform in shape across any cross section thereof orthogonal to the axial direction.

3. The air conditioner according to claim 2, wherein, the plurality of twisted portions are provided on the rear guider, and occupies a part between a closest position which is closest to the outer periphery of the cross flow fan and the at least one leading end.

4. The air conditioner according to claim 2, wherein, the plurality of twisted portions are provided on the stabilizer, and occupies a closest position which is closest to the outer periphery of the cross flow fan.

5. The air conditioner according to claim 1, wherein, the vanes included in the cross flow fan are provided in a plurality of; vane wheels lined up in the axial direction, the plurality of vane wheels including at least two neighboring vane wheels, the vanes of two neighboring vane wheels are deviated from one another in the circumferential direction, and a connecting portion connecting two neighboring twisted portions with each other is positioned to oppose a connecting portion connecting the two neighboring vane wheels.

6. The air conditioner according to claim 5, wherein, the plurality of twisted portions are provided on the rear guider, and occupies a part between a closest position which is closest to the outer periphery of the cross flow fan and the at least one leading end.

7. The air conditioner according to claim 5, wherein, the plurality of twisted portions are provided on the stabilizer, and occupies a closest position which is closest to the outer periphery of the cross flow fan.

8. The air conditioner according to claim 5, wherein, in a direction from one end to an other end of the cross flow fan in the axial direction, a direction of deviation in the circumferential direction between opposing end portions of the two neighboring twisted portions in the axial direction is identical with a direction of deviation in the circumferential direction between the vanes of the two neighboring vane wheels.

9. The air conditioner according to claim 8, wherein, the plurality of twisted portions are provided on the rear guider, and occupies a part between a closest position which is closest to the outer periphery of the cross flow fan and the at least one leading end.

10. The air conditioner according to claim 8, wherein, the plurality of twisted portions are provided on the stabilizer, and occupies a closest position which is closest to the outer periphery of the cross flow fan.

11. The air conditioner according to claim 8, wherein, a deviation angle in the circumferential direction between the opposing end portions of the two neighboring twisted portions in the axial direction is not smaller than 50% and not larger than 150% of a deviation angle in the circumferential direction between the vanes of the two neighboring vane wheels.

12. The air conditioner according to claim 11, wherein, the plurality of twisted portions are provided on the rear guider, and occupies a part between a closest position which is closest to the outer periphery of the cross flow fan and the at least one leading end.

13. The air conditioner according to claim 1, wherein, the plurality of twisted portions are provided on the rear guider, and occupies a part between a closest position which is closest to the outer periphery of the cross flow fan and the at least one leading end.

14. The air conditioner according to claim 13, wherein, in the plurality of twisted portions in the rear guider, the part between the closest position and the at least one leading end is shaped to bulge away from the cross flow fan.

15. The air conditioner according to claim 1, wherein, the plurality of twisted portions are provided on the stabilizer, and occupies a closest position which is closest to the outer periphery of the cross flow fan.

16. The air conditioner according to claim 15, wherein, in the plurality of twisted portions in the stabilizer, the part occupying the closest position is shaped to bulge away from the cross flow fan.

17. The air conditioner according to claim 1, wherein, leading ends in the circumferential direction of the plurality of twisted portions are at the same height.

18. The air conditioner according to claim 1, wherein, directions of the increment of the amounts of the plurality of twisted portions from the one end to the other end thereof are identical with one another.

* * * * *